US007048509B2

(12) United States Patent
Tominaga et al.

(10) Patent No.: US 7,048,509 B2
(45) Date of Patent: May 23, 2006

(54) AXIAL FLOW TURBINE

(75) Inventors: Junichi Tominaga, Kanagawa (JP); Sakae Kawasaki, Kanagawa (JP); Tadashi Tanuma, Kanagawa (JP); Kenichi Imai, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 25 days.

(21) Appl. No.: 10/487,238

(22) PCT Filed: Aug. 29, 2002

(86) PCT No.: PCT/JP02/08721

§ 371 (c)(1),
(2), (4) Date: Sep. 21, 2004

(87) PCT Pub. No.: WO03/018961

PCT Pub. Date: Mar. 6, 2003

(65) Prior Publication Data

US 2005/0019157 A1 Jan. 27, 2005

(30) Foreign Application Priority Data

Aug. 31, 2001 (JP) ..... 2001-264722

(51) Int. Cl.
*F01D 5/14* (2006.01)

(52) U.S. Cl. ..... 416/223 A

(58) Field of Classification Search ..... 416/223 A, 416/243, DIG. 2, DIG. 5; 415/191, 208.1, 415/208.2

See application file for complete search history.

(56) References Cited

U.S. PATENT DOCUMENTS 1,749,528 A * 3/1930 Freudenreich ..... 416/248
3,475,108 A * 10/1969 Zickuhr ..... 415/194
4,626,174 A * 12/1986 Sato et al. ..... 416/223 A
4,809,498 A * 3/1989 Giffin et al. ..... 60/39.162
4,968,216 A * 11/1990 Anderson et al. ..... 415/199.5
5,203,676 A 4/1993 Ferleger et al.
5,221,181 A * 6/1993 Ferleger et al. ..... 415/181
5,267,834 A 12/1993 Dinh et al.
5,277,549 A * 1/1994 Chen et al. ..... 416/223 A
5,326,221 A 7/1994 Amyot et al.

(Continued)

FOREIGN PATENT DOCUMENTS

EP 985801 3/2000

(Continued)

*Primary Examiner*—Edward K. Look
*Assistant Examiner*—Igor Kershteyn
(74) *Attorney, Agent, or Firm*—Oblon, Spivak, McClelland, Maier & Neustadt, P.C.

(57) ABSTRACT

In the axial turbine according to the present invention, a nozzle blade 1 and/or a movable blade 5 has a profile in which a throat-pitch ratio "s/t" is maximized at a blade-central portion in height, wherein "s" being a shortest distance between a rear edge of a nozzle blade (movable blade) and a back side of another nozzle blade that is adjacent to the nozzle blade, and "t" being a pitch of the nozzle blades disposed in the row, minimized in a position between the blade-central portion in height and a blade-root portion and increased from a minimized value to the blade-root portion. This structure enables to provide the axial turbine, which permits to control flow distribution of the working fluid in the height direction of the blade in the passage between the blades of a turbine nozzle unit and a turbine movable nozzle and reduce the blade profile loss and the secondary flow loss at the blade-root portion, thus making a further improvement in the turbine stage efficiency.

12 Claims, 9 Drawing Sheets

U.S. PATENT DOCUMENTS 5,352,092 A * 10/1994 Ferleger et al. ..... 416/223 A
5,354,178 A * 10/1994 Ferleger et al. ..... 416/223 A
5,524,341 A * 6/1996 Ferleger et al. ..... 29/889.7
6,036,438 A * 3/2000 Imai ..... 415/192
6,283,713 B1 * 9/2001 Harvey et al. ..... 416/193 A
6,848,884 B1 * 2/2005 Kawasaki ..... 415/199.5

FOREIGN PATENT DOCUMENTS

JP 6-272504 9/1994
JP 8-109803 4/1996

* cited by examiner

AXIAL FLOW TURBINE

TECHNICAL FIELD

The present invention relates to an axial turbine, especially to such an axial turbine, which has turbine stages formed by combining turbine nozzle units and turbine movable blade units together and permits to improve remarkably pressure efficiency of the turbine stages.

BACKGROUND TECHNOLOGY

In an axial turbine of a steam turbine or a gas turbine applied, for example, to a power plant, there have recently been reviewed improvement in thermal efficiency, and especially, improvement in a turbine internal efficiency, by which an economic operation can be carried out effectively.

A subject to suppress the secondary flow loss due to the secondary flow of working fluid such as working steam or working gas in a turbine nozzle unit or a turbine movable blade unit, of losses including a blade profile loss occurring in a turbine blade and the secondary flow loss (secondary loss) of the working fluid, as low as possible, in order to improve remarkably the turbine internal efficiency, has been addressed as one of significant subjects of study.

FIG. 10 is a view illustrating a structure of a turbine nozzle unit called the "straight blade", which is conventionally applied to the axial turbine. A plurality of nozzle blades 1 (so called the "stationary blades") is placed in a row in a circumferential direction of a turbine axis, not shown, of an annular passage 4, which is formed between an outer diaphragm ring 2 and an inner diaphragm ring 3.

A plurality of turbine movable blades 5 is placed in the circumferential direction on the downstream side of the nozzle blades 1, so as to correspond to the row arrangement of the nozzle blades 1, as shown in FIG. 8. The turbine movable blades 5 are implanted in a rotor disc 6 in the peripheral direction thereof and are provided at the respective outer peripheral ends with a shroud 7, which prevents the working steam or the working gas (hereinafter referred to as the "working fluid main stream" or merely to as the "main stream") from leaking.

Detailed description will be given below of a mechanism of occurrence of the secondary flow of the working fluid on the nozzle blade 1 (hereinafter referred merely to as the "secondary flow") in the axial turbine having the above-described structure, with reference to FIG. 10, which is a perspective view, in which the turbine nozzle unit is viewed from the outlet side of the nozzle blade 1.

The working fluid main stream flows the passage between the blades in a curved shape. At this stage, a centrifugal force is generated from the back (dorsal) side "B" of the nozzle blade 1 toward the front (ventral) side "F". The centrifugal force is balanced with static pressure so that the static pressure on the front side "F" becomes higher.

On the contrary, the flow velocity of the main stream is high on the back side "B", resulting in the lower static pressure. This causes a pressure gradient to occur from the front side "F" towards the back side "B" in the passage between the blades. The pressure gradient also occurs in a boundary zone formed on the peripheral wall surface of the outer diaphragm ring 2 and the inner diaphragm ring 3 in the similar manner.

However, the flow velocity is low and the centrifugal force becomes small in the boundary zone in the passage between the blades, with the result that endurance against the pressure gradient from the front side "F" towards the back side "B" cannot be maintained, thus producing the secondary flow 8 of the working fluid, which is directed from the front side "F" toward the back side "B".

The secondary flow 8 collides with the back side "B" of the nozzle blade 1 to rise up, thus producing the secondary flow vortexes 9*a*, 9*b* in connection portions at which the nozzle blade 1 is connected to the outer diaphragm ring 2 and the inner diaphragm ring 3 so as to support the nozzle blade 1.

The energy possessed by the main stream of the working fluid is lost partially under the influence of development and diffusion of the secondary flow vortexes 9*a*, 9*b*, and the wall friction due to the secondary flow, in this manner, thus becoming a factor responsible for the remarkably deteriorated turbine internal efficiency. The secondary flow loss also occurs in the turbine movable blade unit in the same manner as the turbine nozzle unit.

There have been disclosed many results of research and many proposals to reduce the secondary flow loss due to the secondary flow vortexes 9*a*, 9*b*, which are generated in the passage between the blades.

There has been disclosed for example a turbine nozzle unit, which has a profile in which a throat-pitch ratio "s/t" expressed by a throat "s", which is defined by the shortest distance between the rear edge of a nozzle blade 1 and the back side "B" of another nozzle blade 1 that is adjacent to the above-mentioned nozzle blade 1, and a pitch "t" of the blades 1 aligned annularly, is maximized at a blade-central portion in height, on the one hand, and decreased at the blade-root portion and the blade-tip portion, on the other hand, as shown in FIG. 9 (see Japanese Laid-Open Patent Publication No. HEI 6-272504).

The above-mentioned turbine nozzle unit has advantages as described below in comparison with a turbine nozzle unit or turbine movable blade unit, which has conventionally been applied for example to a steam turbine and called the "straight blade" type (i.e., the blades placed along the radial lines, which pass through the center of the turbine axis and straightly extend radially). In the turbine nozzle unit called the "straight blade" type, the loss at the blade-central portion in height is small, on the one hand, and the loss at the blade-root portion and the blade-tip portion becomes relatively large, on the other hand, as shown in FIG. 5A. Furthermore, in the turbine movable blade unit called the "straight blade" type, the loss at the blade-central portion in height is small, on the one hand, and the loss at the blade-root portion and the blade-tip portion becomes relatively large, on the other hand, as shown in FIG. 5B. The "loss" means loss of the secondary flow of the working fluid in the following description, unless a definition is specifically given.

On the contrary, in the turbine nozzle unit having the profile in which the throat-pitch ratio "s/t" is maximized at the blade-central portion in height, on the one hand, and decreased at the blade-root portion and the blade-tip portion, on the other hand, as shown in a dotted line in FIG. 4A, the flow rate of the main stream is decreased at the blade-root portion and the blade-tip portion in which the larger loss occurs, on the one hand, and increased at the blade-central portion in height in which the smaller loss occurs, on the other hand. Accordingly, the loss generated in the whole passage in the turbine nozzle unit becomes smaller in comparison with the turbine nozzle unit called the "straight blade" type.

Furthermore, in the turbine movable blade unit having the profile in which the throat-pitch ratio "s/t" is maximized at the blade-central portion in height, on the one hand, and decreased at the blade-root portion and the blade-tip portion, on the other hand, as shown in a dotted line in FIG. 4B, the loss generated in the whole passage in the turbine movable blade unit becomes smaller in comparison with the turbine movable blade unit called the "straight blade" type, in the same manner as the above-described turbine nozzle unit.

In addition, with respect to the other results of research, there has been disclosed a turbine nozzle unit called "compound lean" type in which the nozzle blades 1 bend relative to the radial lines, which pass through the center of the turbine axis (which is indicated by the reference sign "E" in FIG. 10) (see Japanese Laid-Open Patent Publication No. HEI 1-106903).

The turbine nozzle unit called the "compound lean" type has a structure as shown in FIG. 7A in which the rear edge of the blade projects in a curved profile from the blade-tip portion and the blade-root portion towards the blade-central portion in height so as to generate pressing forces, which are applied from the blade-tip portion and the blade-root portion to the outer and inner diaphragm rings 2 and 3, respectively. Accordingly, the turbine nozzle unit called the "compound lean" type makes it possible to keep the small pressure gradient in the boundary zone generated in each of the outer diaphragm ring 2 and the inner diaphragm ring 3.

The turbine movable blade unit also has a structure as shown in FIG. 7B in which the rear edge of the blade projects in a curved profile from the blade-tip portion and the blade-root portion towards the blade-central portion in height so as to generate pressing forces, which are applied from the blade-tip portion and the blade-root portion to a shroud 7 and a rotor disc 6, respectively, in the same manner as the above-described turbine nozzle unit, thus making it possible to keep the small pressure gradient in the boundary zone generated in each of the shroud 7 and the rotor disc 6 (see Japanese Laid-Open Patent Publication No. HEI 3-189303).

The turbine nozzle unit and the turbine movable blade units, which are called the "compound lean" type, have the profile by which the pressing force applied from the blade-tip portion to the outer diaphragm ring 2 as well as the pressing force applied from the blade-root portion to the inner diaphragm ring 3 are given, and the pressure gradient in the boundary zone generated in each of the outer diaphragm ring 2 and the inner diaphragm ring 3 is kept small, thus leading to a larger flowing amount of the main stream.

However, the connection portion of the blade-tip portion to the outer diaphragm 2 and the connection portion of the blade-root portion to the inner diaphragm 3 originally exist as zones where the secondary flow loss of the working fluid is large. Accordingly, there is a limitation for further improvement in performance, even when a larger amount of the main stream of the working fluid is supplied to flow.

In view of this fact, the turbine nozzle unit and the turbine movable blade unit, in which the throat-pitch ratio "s/t" is increased at the blade-central portion in height to ensure a larger area of the passage, cause the main stream to flow in a larger amount in a zone at the blade-central portion in height, in which the small loss occurs. It is therefore conceivable that such a structure can make further improvements in performance, thus providing advantages (see Japanese Laid-Open Patent Publication No. HEI 8-109803).

However, in the turbine nozzle unit and the turbine movable blade unit having the above-described profile, the throat-pitch ratio "s/t" is small at both of the blade-root portion and the blade-tip portion, a geometrical discharge angle "$\alpha=\sin^{-1}(s/t)$", which is calculated from the throat-pitch ratio "s/t" is also small, and a turning angle becomes large.

It is known that, when the turbine nozzle unit and the turbine movable blade unit of the axial turbine generally have the small geometrical discharge angle or the large turning angle, the boundary zone develops on the surface of the blade, thus increasing the blade profile loss.

When the flowing direction of the main stream is drastically changed in the passage between the blades, the pressure gradient from the front side "F" towards the back side "B" in the passage between the blades becomes large and the secondary flow 8 also becomes large.

In addition, fluid having a low energy, in the boundary zones on the surface of the blade, which develop in the vicinity of the blade-root portion and the blade-tip portion, as well as fluid having a low energy, in the boundary zones formed on the peripheral wall surfaces in the passage between the blades flow together with the secondary flow 8, thus constituting a factor responsible for the remarkably increased secondary flow loss.

Especially, the small throat-pitch ratio "s/t" in the blade-root portion makes the annular pitch "t" small, thus leading to a small throat "s". The small throat "s" causes a ratio "te/s" of the thickness "te" of the rear edge in the throat "s" to become large, since it is required that the thickness "te" of the rear edge in the throat "s" has a predetermined value based on the structural requirement of the blade. As a result, the blade profile loss rapidly increases as shown in FIG. 11.

The turbine nozzle unit and the turbine movable blade unit in which the throat-pitch ratio "s/t" is increased at the blade-central portion in height, as well as the other turbine nozzle unit and the other turbine movable blade unit, which are called the "compound lean" type, any one of which have been disclosed as one of the results of the recent research, have merits and demerits as described above. It is therefore conceivable that combination of them only in their structure providing the merits, i.e., realization of a so-called "hybrid blade" makes contribution to the further improvement in the turbine stage efficiency.

An object of the present invention, which was made in view of the above-mentioned problems, is therefore to provide an axial turbine, which permits to control flow distribution of the main stream in the height direction of the blade in the passage between the blades of a turbine nozzle unit and a turbine movable nozzle and reduce the blade profile loss and the secondary flow loss at the blade-root portion, thus making a further improvement in the turbine stage efficiency.

DISCLOSURE OF THE INVENTION

In order to attain the above-described object, an axial turbine according to the present invention comprises: a plurality of turbine stages disposed in an axial direction of a turbine shaft, each of the plurality of turbine stages comprising a turbine nozzle unit having nozzle blades, which are disposed in a row in a circumferential direction of an annular passage formed between an outer diaphragm ring and an inner diaphragm ring; and a turbine movable blade unit, which is disposed on a downstream side of the turbine nozzle unit and has movable blades implanted in a row on the turbine shaft in a circumferential direction thereof, wherein the nozzle blades have a profile in which a throat-pitch ratio "s/t" is maximized at a blade-central portion in height, wherein "s" being a shortest distance between a rear edge of a nozzle blade and a back side of another nozzle blade that is adjacent to the nozzle blade, and "t" being a pitch of the nozzle blades disposed in the row, minimized in a position between the blade-central portion in height and a blade-root portion, and increased from a minimized value to the blade-root portion.

The minimized value of the throat-pitch ratio "s/t" of the nozzle blades is preferably a smallest value.

A geometrical discharge angle "$\alpha=\sin^{-1}(s/t)$", which is calculated from the throat-pitch ratio "s/t" in the blade-root portion of the nozzle blades, is preferably set within a range of from at least 105% to up to 115% of the geometrical discharge angle calculated from the minimum value of the throat-pitch ratio "s/t".

The nozzle blades may have a cross section, which curves towards a fluid flowing side in the circumferential direction so that an extremely projecting portion exists in the blade-central portion in height.

The nozzle blades may incline or curve at a rear edge position thereof towards either one of an upstream side opposing against the flow of fluid and a downstream side following the flow of the fluid.

The nozzle blades may have a cross section so that a length of a chord of blade is maximized at the blade-tip portion and minimized at the blade-root portion.

The object of the present invention can be also achieved by providing, in another aspect, an axial turbine comprising: a plurality of turbine stages disposed in an axial direction of a turbine shaft, each of the plurality of turbine stages comprising a turbine nozzle unit having nozzle blades, which are disposed in a row in a circumferential direction of an annular passage formed between an outer diaphragm ring and an inner diaphragm ring; and a turbine movable blade unit, which is disposed on a downstream side of the turbine nozzle unit and has movable blades implanted in a row on the turbine shaft in a circumferential direction thereof, wherein the movable blades have a profile in which a throat-pitch ratio "s/t" is maximized at a blade-central portion in height, wherein "s" being a shortest distance between a rear edge of a movable blade and a back side of another movable blade that is adjacent to the movable blade, and "t" being a pitch of the movable blades disposed in the row, minimized in a position between the blade-central portion in height and a blade-root portion and increased from a minimized value to the blade-root portion.

In this aspect, the throat-pitch ratio "s/t", which is increased from the minimized value to the blade-root portion, may be maximized at the blade-root portion.

In addition, a geometrical discharge angle "$\alpha=\sin^{-1}(s/t)$", which is calculated from the throat-pitch ratio "s/t" in the blade-root portion of the movable blades, may be set within a range of from at least 105% to up to 115% of the geometrical discharge angle calculated from the minimum value of the throat-pitch ratio "s/t".

The movable blades may have a cross section, which curves towards a fluid flowing side in the circumferential direction so that an extremely projecting portion exists in the blade-central portion in height.

The movable blades may incline or curve at a rear edge position thereof towards either one of an upstream side opposing against the flow of fluid and a downstream side following the flow of the fluid.

In addition, the object of the present invention can be also achieved by providing, in a further aspect, an axial turbine comprising: a plurality of turbine stages disposed in an axial direction of a turbine shaft, each of the plurality of turbine stages comprising a turbine nozzle unit having nozzle blades, which are disposed in a row in a circumferential direction of an annular passage formed between an outer diaphragm ring and an inner diaphragm ring; and a turbine movable blade unit, which is disposed on a downstream side of the turbine nozzle unit and has movable blades implanted in a row on the turbine shaft in a circumferential direction thereof, wherein the nozzle blades have a profile in which a throat-pitch ratio "s/t" is maximized at a blade-central portion in height, wherein "s" being a shortest distance between a rear edge of a nozzle blade and a back side of another nozzle blade that is adjacent to the nozzle blade, and "t" being a pitch of the nozzle blades disposed in the row, minimized in a position between the blade-central portion in height and a blade-root portion, and increased from a minimized value to the blade-root portion; and the movable blades have a profile in which a throat-pitch ratio "s/t" is maximized at a blade-central portion in height, wherein "s" being a shortest distance between a rear edge of a movable blade and a back side of another movable blade that is adjacent to the movable blade, and "t" being a pitch of the movable blades disposed in the row, minimized in a position between the blade-central portion in height and a blade-root portion and increased from a minimized value to the blade-root portion.

BRIEF DESCRIPTION OF THE DRAWINGS

FIG. 4 shows throat-pitch ratio "s/t" distribution maps in comparison between the prior art and the present invention, in which

FIG. 5 shows loss distribution maps in which comparison in loss between the prior art and the present invention is made, in which

FIG. 7 illustrates blades, which are applied to the conventional axial turbine and viewed from the outlet side of the main stream, in which

BEST MODE FOR CARRYING OUT THE INVENTION

Hereunder, embodiments of an axial turbine according to the present invention will be described with reference to the drawings. A steam turbine or a gas turbine is conceivable as the axial turbine described below, and an example thereof is schematically shown in FIG. 12.

Figure 12:
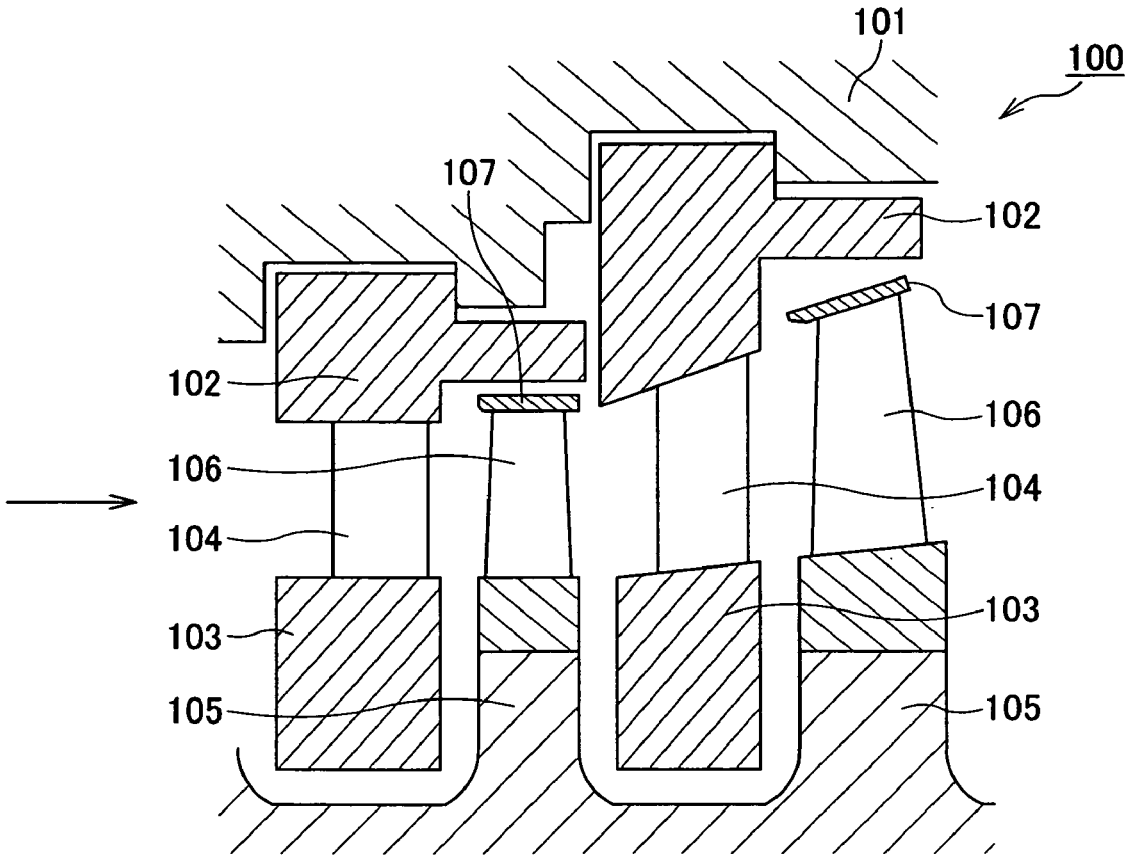
FIG. 12 is a conceptual view illustrating an example of stages of the axial turbine provided with nozzle diaphragms.

More specifically, FIG. 12 shows the stages of the axial turbine 100 provided with nozzle diaphragms. Nozzle blades 104 are fixed to an outer diaphragm ring 102 and an inner diaphragm ring 103, which are secured in a turbine casing 101, to form nozzle blade passages. A plurality of turbine movable blades 106 is disposed on the downstream side of the respective blade passages. The movable blades 106 are implanted on the outer periphery of a rotor disc (wheel) 105 in a row at predetermined intervals. A cover 107 is attached on the outer peripheral edges of the movable blades 106 in order to prevent leakage of a working fluid in the movable blades.

In FIG. 12, the working fluid, i.e., steam "S" flows from the right-hand side (i.e., the upstream side) of the turbine in the figure towards the left-hand side (i.e., the downstream side).

Figure 1:
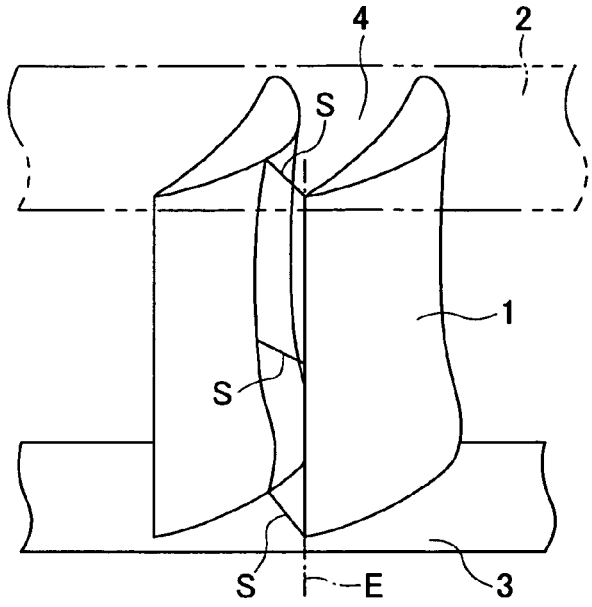
FIG. 1 is a perspective view illustrating a turbine nozzle unit applied to an axial turbine according to the present invention, which is viewed from an outlet side of a main stream of a working fluid.

FIG. 1 is a perspective view of the turbine nozzle unit applied to the axial turbine according to the present invention, which is viewed from the outlet side at the rear edge. In FIG. 1, a plurality of nozzle blades 1 is disposed at predetermined intervals in a row in a circumferential direction of an annular passage 4, which is formed between the outer diaphragm ring 2 and the inner diaphragm ring 3 and each of the nozzle blades is connected, at a blade-tip portion and blade-root portion thereof, to the outer diaphragm ring 2 and the inner diaphragm ring 3, respectively, so as to constitute a turbine nozzle unit.

Figure 2:
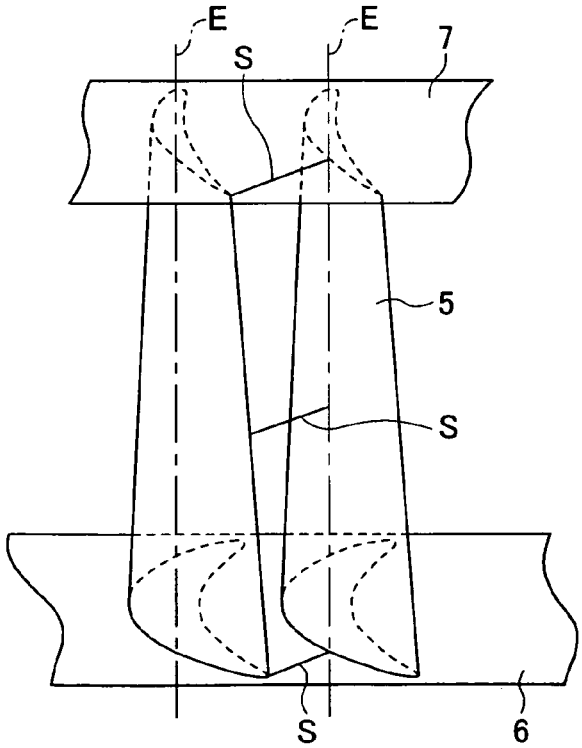
FIG. 2 is a perspective view illustrating a turbine movable blade unit applied to an axial turbine according to the present invention, which is viewed from an outlet side of a main stream.

FIG. 2 is a perspective view illustrating the movable blades 5, which are disposed on the downstream side of the turbine nozzle unit relative to the flow direction of the working fluid. Blade-tip portions are supported by means of a shroud 7, and blade-implanted portions (i.e., blade-root portions) are implanted into the rotor disc 6.

Figure 3:
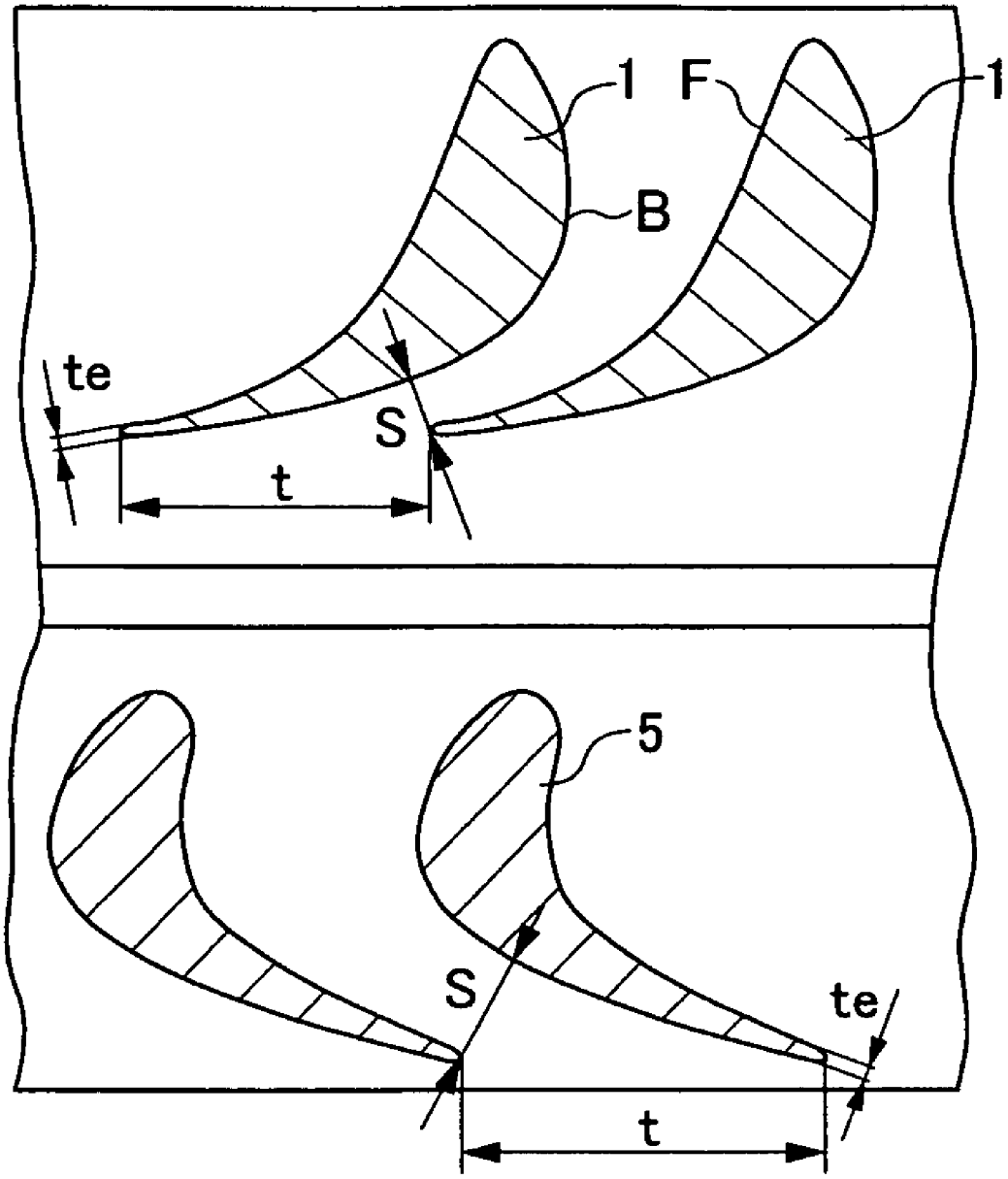
FIG. 3 is a cross-sectional view illustrating the turbine nozzle unit and the turbine movable blade unit applied to the axial turbine according to the present invention, in order to explain a flow passage thereof.

FIG. 3 shows a cross-section in a working fluid passage between the nozzle blades 1 and the movable blades 5. A throat-pitch ratio "s/t" is used as a parameter by which a flowing direction and an amount of the working fluid from the outlet of the nozzle unit or the movable blade unit is determined, wherein the throat "s" being the shortest distance between the rear edge of the nozzle blade 1 or the movable blade 5 and a back side of another nozzle blade 1 or another movable blade 5 that is adjacent to the former nozzle blade 1 or the former movable blade 5, i.e., the minimum passage width of the working fluid passage, and the annular pitch (i.e., the pitch of the movable blades disposed in the row) "t" being a number obtained by dividing the length in the circumferential direction along a turbine shaft (not shown) by the number of nozzles or movable blades. A solid line in FIG. 4A shows the throat-pitch ratio "s/t" of the nozzle blade 1, based on the above-mentioned parameter, in the form of distribution in blade height, and a solid line in FIG. 4B shows the throat-pitch ratio "s/t" of the movable blade 5, based on the above-mentioned parameter, in the form of distribution in blade height.

Figure 4A:
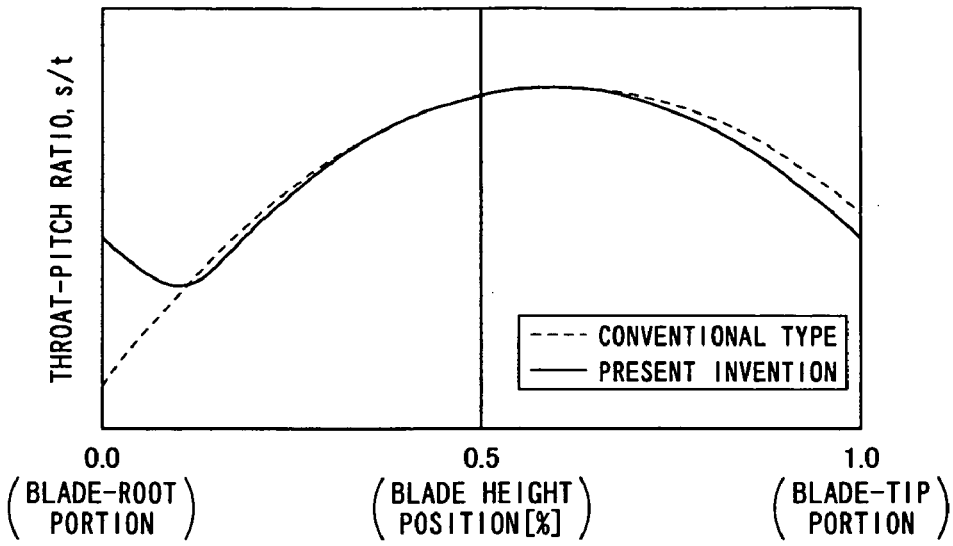
FIG. 4A is a throat-pitch ratio "s/t" distribution map of the turbine nozzle unit and FIG. 4B is a throat-pitch ratio "s/t" distribution map of the turbine movable blade unit.
Figure 4B:
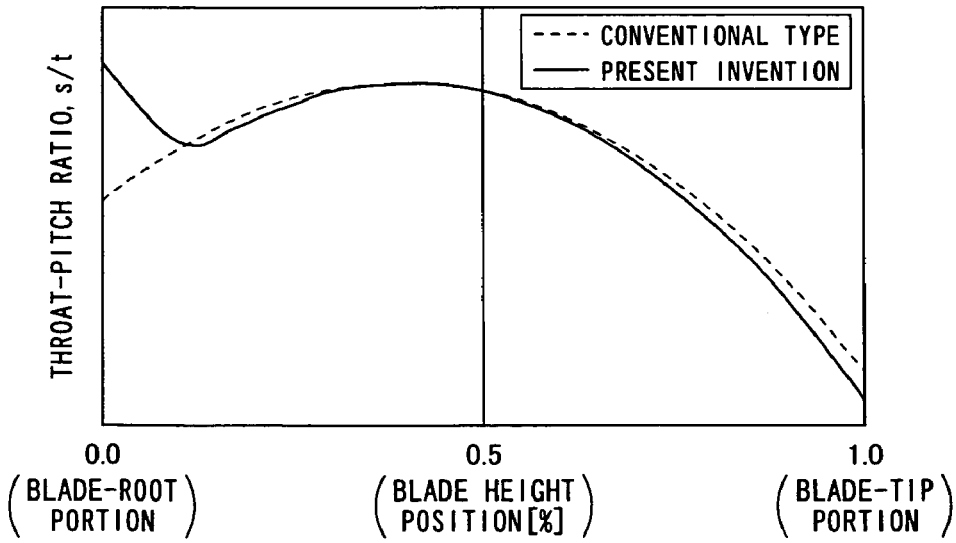

In the axial turbine according to the present invention, the throat-pitch ratio "s/t" of both of the turbine nozzle unit and the turbine movable blade unit is maximized at the blade-central portion in height as shown in the solid lines in FIGS. 4A, 4B, in the same manner as the conventional unit as shown in the dotted lines in these figures.

In addition, in the axial turbine according to the present invention, the throat-pitch ratio "s/t" of both of the turbine nozzle unit and the turbine movable blade unit is minimized at a position between the blade-central portion and the blade-root portion, and the throat-pitch ratio "s/t" at the blade-root portion is larger than that of the conventional unit as shown in the dotted lines.

In the axial turbine according to the present invention, the minimum value of the throat-pitch ratio "s/t" of the turbine nozzle unit is set as the smallest value in height of the blade, and the throat-pitch ratio "s/t" in the blade-root portion of the turbine movable blade unit is set as the largest value in height of the blade.

A blade profile in which the throat-pitch ratio "s/t" of both of the turbine nozzle unit and the turbine movable blade unit is maximized at the blade-central portion in height, the throat-pitch ratio at the position between the blade-central portion and the blade-root portion is minimized and the throat-pitch ratio is increased from this position towards the blade-root portion, can easily be realized, for example, by applying a twist to the blade or changing the cross section of the blade.

Figure 5A:
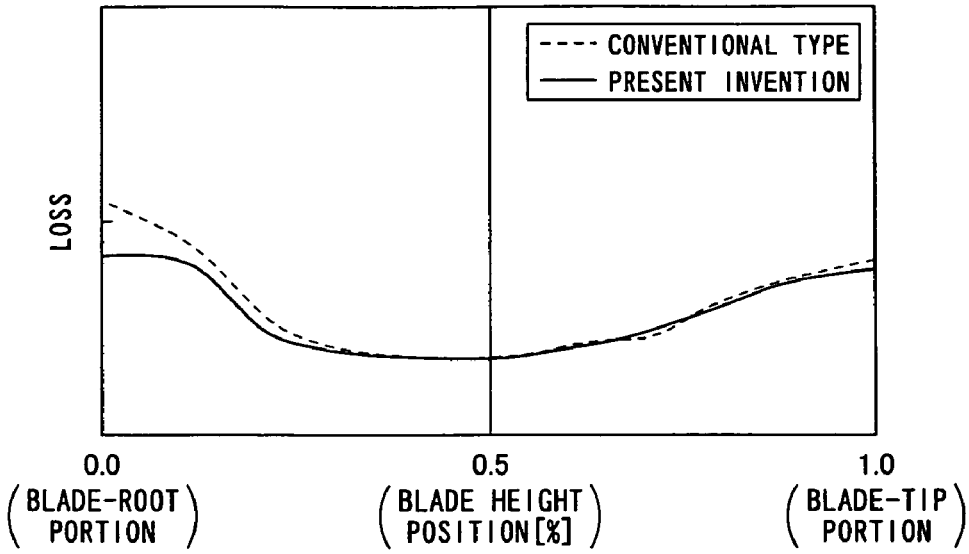
FIG. 5A is a loss distribution map of the turbine nozzle unit and FIG. 5B is a loss distribution map of the turbine movable blade unit.
Figure 5B:
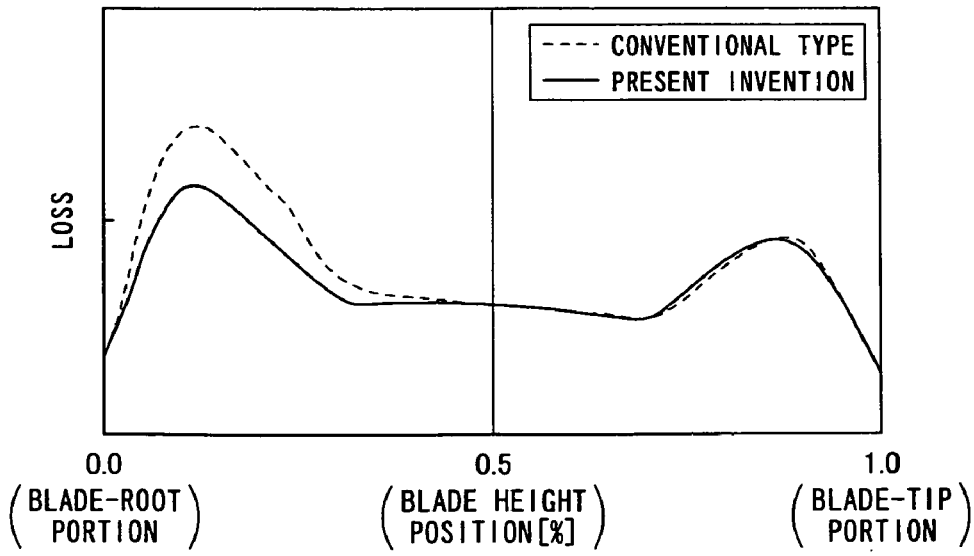

The loss distribution of the turbine nozzle unit and the turbine movable blade unit is generally decreased at the blade-central portion in height, on the one hand, and increased at the blade-root portion and the blade-tip portion, as shown in the dotted lines in FIGS. 5A, 5B. As a result, in both of the conventional turbine nozzle unit and the turbine movable blade unit, the main stream of the working fluid flows in a larger amount at the blade-central portion in height in which the secondary flow loss (i.e., the secondary loss) of the working fluid is small, on the one hand, and flows in a smaller amount at the blade-root portion and the blade-tip portion, in which the secondary flow loss is large, on the other hand.

In the embodiment of the present invention, the throat-pitch ratio "s/t" of both of the turbine nozzle unit and the turbine movable blade unit is maximized at the blade-central portion in height as shown in the solid lines in FIGS. 4A, 4B, the throat-pitch ratio is minimized at the position between the blade-central portion and the blade-root portion and the throat-pitch ratio "s/t" at the blade-root portion is increased so that the main stream of the working fluid flows in a larger amount at the blade-central portion in height where the secondary flow loss is small, on the one hand, and flows in a smaller amount at the blade-root portion and the blade-tip portion where the secondary flow loss is large, on the other hand, thus making it possible to improve the turbine stage efficiency in comparison with the conventional unit. Especially, throat-pitch ratio "s/t" of both of the turbine nozzle unit and the turbine movable blade unit is minimized at the position between the blade-central portion in height and the blade-root portion and the throat-pitch ratio is increased from this position towards the blade-root portion so as to reduce the loss such as the secondary flow loss, thus making it possible to further improve the turbine stage efficiency.

In addition, according to the embodiment of the present invention, the geometrical discharge angle "$\alpha=\sin^{-1}(s/t)$" at the blade-root portion is increased and the turning angle is decreased, thus making it possible to remarkably reduce the blade profile loss and the secondary flow loss in comparison with the conventional unit. FIG. 5A shows a loss distribution map of the turbine nozzle unit and FIG. 5B is a loss distribution map of the turbine movable blade unit.

Figure 6:
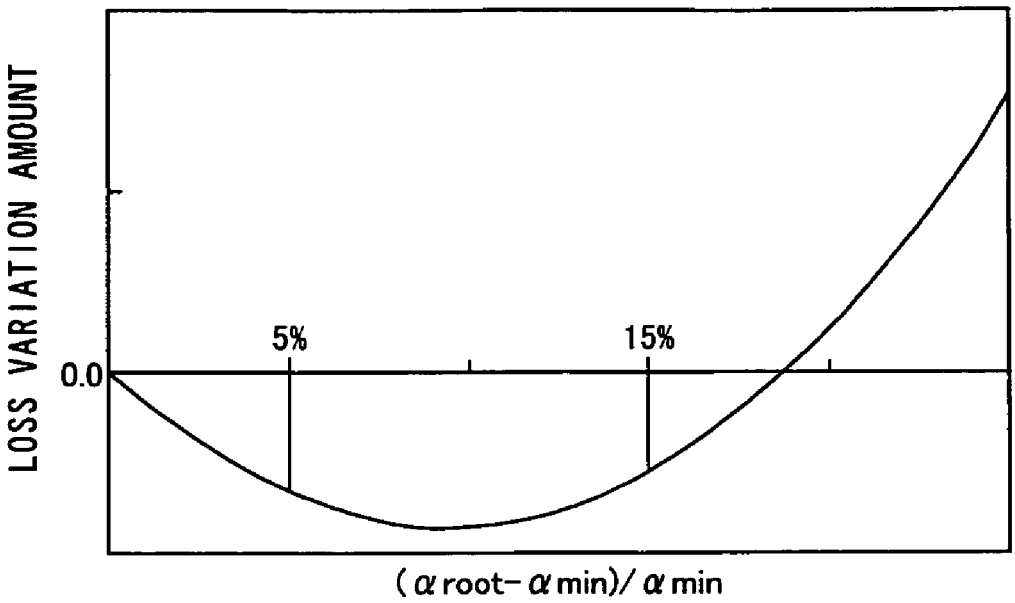
FIG. 6 is a distribution map of a loss variation amount showing a relationship between a geometrical discharge angle and the loss variation amount in a blade-root portion of the turbine nozzle unit and the turbine movable blade unit, which are applied to the axial turbine according to the present invention.

As shown in FIG. 6 based on analysis results, it is possible to reduce the loss by limiting the geometrical discharge angle "$\alpha=\sin^{-1}(s/t)$" at the blade-root portion of the turbine nozzle unit and the turbine movable blade unit within the range of 105%%α%115%, on the basis of the minimum value, more concretely, [(geometrical discharge angle at the blade-root portion $\alpha_{root}$–the minimum value of geometrical discharge angle $\alpha_{min}$)/(the minimum value of geometrical discharge angle $\alpha_{min}$)].

Figure 7A:
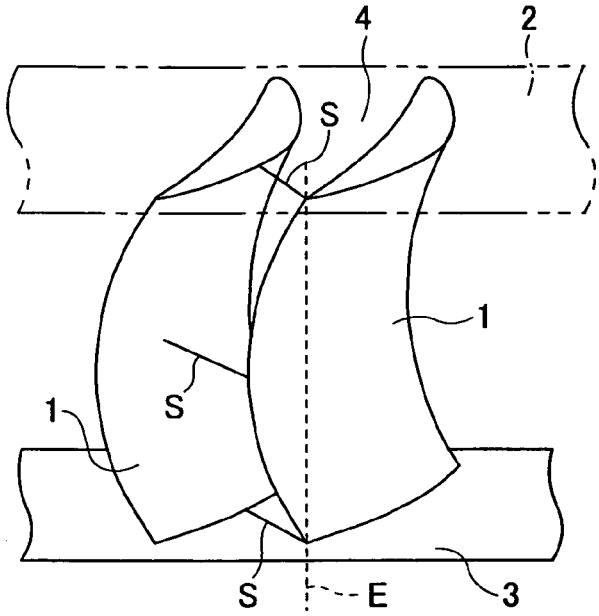
FIG. 7A is a perspective view of the turbine nozzles and FIG. 7B is a perspective view of the turbine movable blades.
Figure 7B:
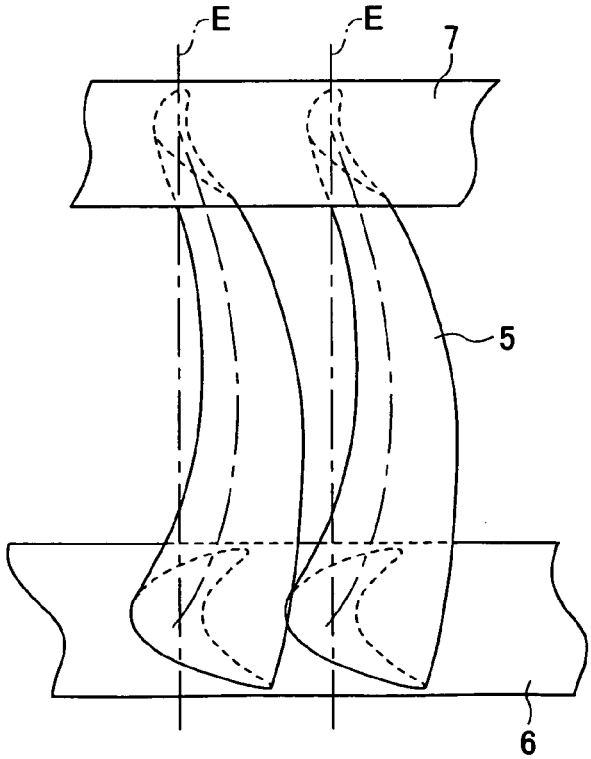

In the embodiment of the present invention, the throat-pitch ratio "s/t" distribution, which provides the profile, in which the throat-pitch ratio "s/t" at the blade-central portion in height is minimized, the throat-pitch ratio "s/t" at the position between the blade-central portion in height and the blade-root portion is minimized and the throat-pitch ratio "s/t" at the blade-root portion is increased, may be applied to the so-called "compound lean type" turbine nozzle unit and turbine movable blade unit, as shown in FIGS. 7A, 7B. This can also be easily realized by taking measures such as application of the twist to the blades in cross section of the turbine nozzle unit and the turbine movable blade unit.

In the turbine nozzle unit and the turbine movable blade unit, the blade-central portion in height in cross-section is shifted towards the circumferential direction relative to the radial line "E", and more specifically, there exists an extremely projecting portion so as to project at the blade-central portion in height from the nozzle blade 1 or the movable blade 5 towards the back side "B" of the other nozzle blade 1 or the other movable blade 5, which is adjacent to the front side "F" of the former blade 1 or 5, with the result that the above-mentioned extremely projecting portion curves towards the flowing side of the main stream in the circumferential direction. A shifting amount (i.e., an projecting amount) of this portion is determined based on the magnitude of the secondary flow loss generated at the blade-root portion and the blade-tip portion. With respect to the most suitable value for this shifting amount, an angle between the blade surface of the nozzle blade 1 or the movable blade 5 and the radial line "E" is 10° at the blade-root portion, on the one hand, and 5° at the blade-tip portion, on the other hand. The shifting amount (i.e., the projecting amount) exceeding the above-mentioned suitable value causes occurrence of a drastic change in streamline, thus providing unfavorable effects.

Accordingly, a permissible range of the shifting amount (i.e., the projecting amount) in cross-section of the blade is set as "10°±5°" at a zone from the blade-root portion towards the blade-central portion in height, on the one hand, and as "5°±5°" at a zone from the blade-tip portion towards the blade-central portion, on the other hand.

Figure 8:
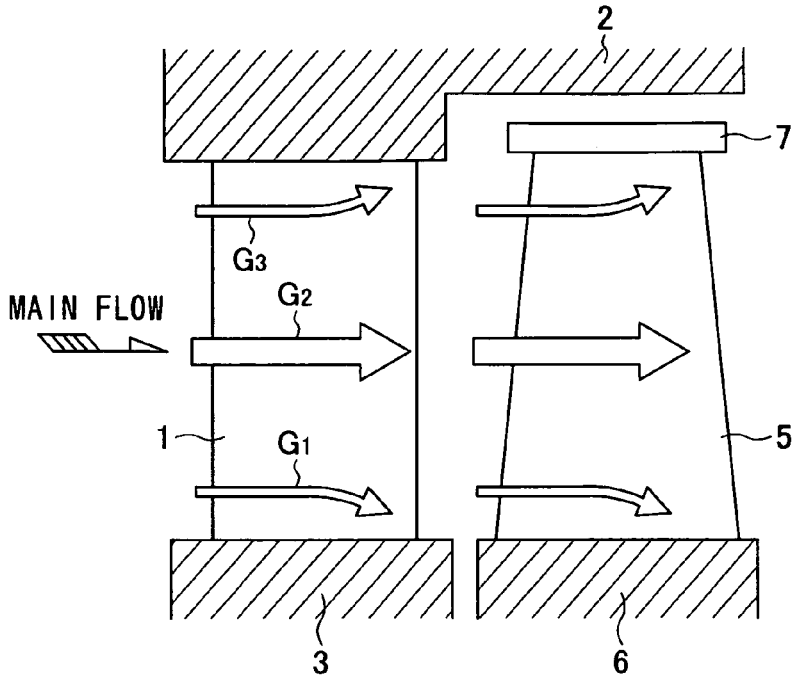
FIG. 8 is a conceptual view used for explaining the stream of the main stream, which flows through the turbine nozzle unit and the turbine blade unit that are applied to the axial turbine according to the present invention.

It is possible to cause, of the streams $G_1$, $G_2$, $G_3$ flowing between the nozzle blades 1 and then the movable blades 5, the stream $G_1$ to flow towards the blade-root portion, on the one hand, and the stream $G_3$ to flow towards the blade-tip portion, on the other hand, as shown in FIG. 8, thus leading to a low rate of occurrence of the secondary flow of the working fluid, by applying the throat-pitch ratio "s/t" distribution, which provides the profile in which the throat-pitch ratio "s/t" at the blade-central portion in height is minimized, the throat-pitch ratio "s/t" at the position between the blade-central portion in height and the blade-root portion is minimized and the throat-pitch ratio "s/t" at the blade-root portion is increased in this manner, to the so-called "compound lean type" turbine nozzle unit and turbine movable blade unit, as shown in FIGS. 7A, 7B.

Alternatively, the throat-pitch ratio "s/t" distribution, which provides the profile in which the throat-pitch ratio "s/t" at the blade-central portion in height is minimized, the throat-pitch ratio "s/t" at the position between the blade-central portion in height and the blade-root portion is minimized and the throat-pitch ratio "s/t" at the blade-root portion is increased, may be applied to the so-called "taper type" turbine nozzle unit and turbine movable blade unit.

Figure 9:
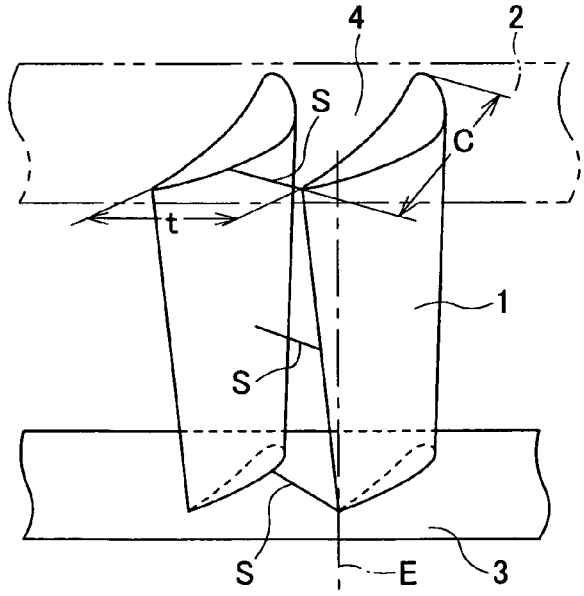
FIG. 9 is a perspective view of another turbine nozzle unit applied to the conventional axial turbine, viewed from the outlet side of the main stream.
Figure 10:
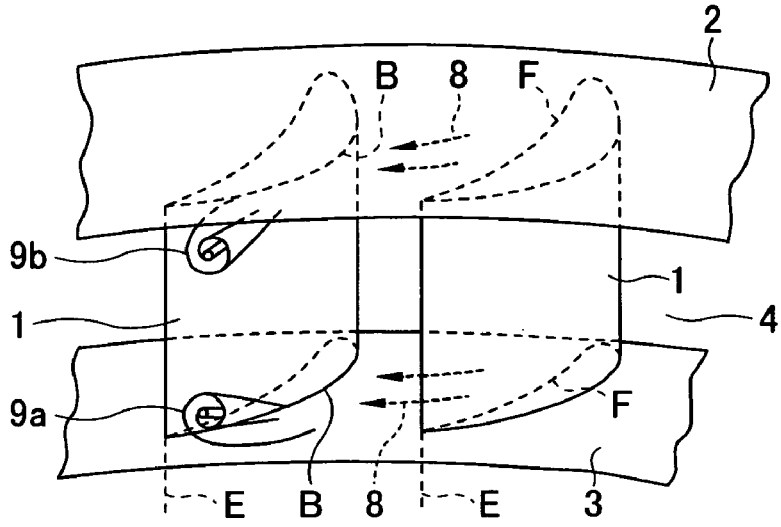
FIG. 10 is a conceptual view used for explaining the stream of the main stream, which flows through the turbine nozzle unit applied to the conventional axial turbine.
Figure 11:
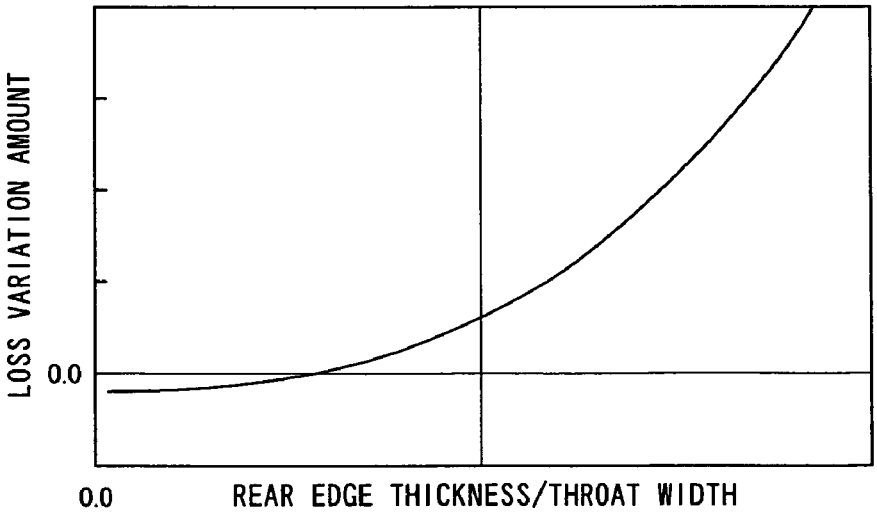
FIG. 11 is a loss distribution map, which shows loss at a rear edge of the turbine nozzle blades applied to the conventional axial turbine.

In the so-called "taper type" turbine nozzle unit, the length of the blade chord "C" is gradually increased from the blade-root portion towards the blade-tip portion on the observation based on the radial line "E", as shown in FIG. 9, and the ratio of the blade chord "C" to the annular pitch "t" is determined so as to reduce the blade profile loss in cross-section of the respective blade in the direction of the height of the blade.

It is also possible to ensure a low rate of occurrence of the secondary flow by applying the throat-pitch ratio "s/t" distribution, which provides the profile, in which the throat-pitch ratio "s/t" at the blade-central portion in height is minimized, the throat-pitch ratio "s/t" at the position between the blade-central portion in height and the blade-root portion is minimized and the throat-pitch ratio "s/t" at the blade-root portion is increased, to the so-called "taper type" turbine nozzle unit.

In the case where the throat-pitch ratio "s/t" distribution, which provides the profile, in which the throat-pitch ratio "s/t" at the blade-central portion in height is minimized, the throat-pitch ratio "s/t" at the position between the blade-central portion in height and the blade-root portion is minimized and the throat-pitch ratio "s/t" at the blade-root portion is increased, is applied to both of the turbine nozzle unit and the turbine movable blade unit, in the embodiment of the present invention, it is also possible to ensure a low rate of occurrence of the secondary flow by inclining or curving the rear edge of each of the turbine nozzle blade and the turbine movable blade towards the upstream side opposing against the flow of the main stream or the downstream side following the flow of the main stream.

It is therefore possible to remarkably reduce the loss of the turbine nozzle unit and the turbine movable blade unit and provide much power, to improve the efficiency of the turbine stage, when the throat-pitch ratio "s/t" distribution, which provides the profile in which the throat-pitch ratio "s/t" at the blade-central portion in height is minimized, the throat-pitch ratio "s/t" at the position between the blade-central portion in height and the blade-root portion is minimized and the throat-pitch ratio "s/t" at the blade-root portion is increased, is applied, for example, to the so-called "compound lean type" turbine nozzle unit and turbine movable blade unit, or the "taper type" turbine nozzle unit and turbine movable blade unit, to constitute the turbine stage.

INDUSTRIAL APPLICABILITY

According to the axial turbine according to the present invention, the throat-pitch ratio "s/t" distribution, which provides the profile in which the throat-pitch ratio "s/t" at the blade-central portion in height is minimized, the throat-pitch ratio "s/t" at the position between the blade-central portion in height and the blade-root portion is minimized and the throat-pitch ratio "s/t" at the blade-root portion is increased, is applied to each of the turbine nozzle unit and the turbine movable blade unit to constitute the turbine stage. It is therefore possible to cause the main stream of the working fluid to flow in a larger amount at the blade-central portion in height so as to provide much power, and increase the geometrical discharge angle "$\alpha=\sin^{-1}(s/t)$" at the blade-root portion so as to remarkably reduce the blade profile loss and the secondary flow loss of the working fluid.

According to the embodiment of the present invention, it is therefore possible to improve remarkably the stage efficiency of the turbine stage to increase the power per the turbine stage.

What is claimed is:

1. An axial turbine comprising: a plurality of turbine stages disposed in an axial direction of a turbine shaft, each of the plurality of turbine stages comprising a turbine nozzle unit having nozzle blades, which are disposed in a row in a circumferential direction of an annular passage formed between an outer diaphragm ring and an inner diaphragm ring; and a turbine movable blade unit, which is disposed on a downstream side of the turbine nozzle unit and has movable blades implanted in a row on the turbine shaft in a circumferential direction thereof, wherein said nozzle blades have a profile in which a throat-pitch ratio "s/t" is maximized at a blade-central portion in height, wherein "s" being a shortest distance between a rear edge of a nozzle blade and a back side of another nozzle blade that is adjacent to said nozzle blade, and "t" being a pitch of the nozzle blades disposed in the row, minimized in a position between the blade-central portion in height and a blade-root portion and increased from a minimized value to said blade-root portion.

2. An axial turbine according to claim 1, wherein said minimized value of the throat-pitch ratio "s/t" of the nozzle blades is a smallest value.

3. An axial turbine according to claim 1, wherein a geometrical discharge angle "$\alpha=\sin^{-1}(s/t)$", which is calculated from the throat-pitch ratio "s/t" in the blade-root portion of the nozzle blades, is set within a range of from at least 105% to up to 115% of the geometrical discharge angle calculated from the minimum value of the throat-pitch ratio "s/t".

4. An axial turbine according to claim 1, wherein said nozzle blades have a cross section, which curves toward a fluid flowing side in the circumferential direction so that an extremely projecting portion exists in the blade-central portion in height.

5. An axial turbine according to claim 1, wherein said nozzle blades incline or curve at a rear edge position thereof towards either one of an upstream side opposing against flow of fluid and a downstream side following the flow of the fluid.

6. An axial turbine according to claim 1, wherein said nozzle blades have a cross section so that a length of a chord of blade is maximized at the blade-tip portion and minimized at the blade-root portion.

7. An axial turbine comprising: a plurality of turbine stages disposed in an axial direction of a turbine shaft, each of the plurality of turbine stages comprising a turbine nozzle unit having nozzle blades, which are disposed in a row in a circumferential direction of an annular passage formed between an outer diaphragm ring and an inner diaphragm ring; and a turbine movable blade unit, which is disposed on a downstream side of the turbine nozzle unit and has movable blades implanted in a row on the turbine shaft in a circumferential direction thereof, wherein said movable blades have a profile in which a throat-pitch ratio "s/t" is maximized at a blade-central portion in height, wherein "s" being a shortest distance between a rear edge of a movable blade and a back side of another movable blade that is adjacent to said movable blade, and "t" being a pitch of the movable blades disposed in the row, minimized in a position between the blade-central portion in height and a blade-root portion and increased from a minimized value to said blade-root portion.

8. An axial turbine according to claim 7, wherein said throat-pitch ratio "s/t", which is increased from the minimized value to the blade-root portion, is maximized at the blade-root portion.

9. An axial turbine according to claim 7, wherein a geometrical discharge angle "$\alpha=\sin^{-1}(s/t)$", which is calculated from the throat-pitch ratio "s/t" in the blade-root portion of the movable blades, is set within a range of from at least 105% to up to 115% of the geometrical discharge angle calculated from the minimum value of the throat-pitch ratio "s/t".

10. An axial turbine according to claim 7, wherein said movable blades have a cross section, which curves towards a fluid flowing side in the circumferential direction so that an extremely projecting portion exists in the blade-central portion in height.

11. An axial turbine according to claim 7, wherein said movable blades incline or curve at a rear edge position thereof towards either one of an upstream side opposing against flow of fluid and a downstream side following the flow of the fluid.

12. An axial turbine comprising: a plurality of turbine stages disposed in an axial direction of a turbine shaft, each of the plurality of turbine stages comprising a turbine nozzle unit having nozzle blades, which are disposed in a row in a circumferential direction of an annular passage formed between an outer diaphragm ring and an inner diaphragm ring; and a turbine movable blade unit, which is disposed on a downstream side of the turbine nozzle unit and has movable blades implanted in a row on the turbine shaft in a circumferential direction thereof, wherein said nozzle blades have a profile in which a throat-pitch ratio "s/t" is maximized at a blade-central portion in height, wherein "s" being a shortest distance between a rear edge of a nozzle blade and a back side of another nozzle blade that is adjacent to said nozzle blade, and "t" being a pitch of the nozzle blades disposed in the row, minimized in a position between the blade-central portion in height and a blade-root portion, and increased from a minimized value to said blade-root portion, and said movable blades have a profile in which a throat-pitch ratio "s/t" is maximized at a blade-central portion in height, wherein "s" being a shortest distance between a rear edge of a movable blade and a back side of another movable blade that is adjacent to said movable blade, and "t" being a pitch of the movable blades disposed in the row, minimized in a position between the blade-central portion in height and a blade-root portion and increased from a minimized value to said blade-root portion.

* * * * *